US011186400B2

(12) United States Patent
Bohn et al.

(10) Patent No.: US 11,186,400 B2
(45) Date of Patent: Nov. 30, 2021

(54) METHOD FOR UNPACKING AND SEPARATING INFUSION BAGS INTO SINGLES FOR SUPPLYING THE BAGS TO A DEVICE FOR FURTHER PROCESSING

(71) Applicant: Harro Höfliger Verpackungsmaschinen GmbH, Allmersbach im Tal (DE)

(72) Inventors: Markus Bohn, Allmersbach im Tal (DE); Ulrich Stahl, Allmersbach im Tal (DE)

(73) Assignee: Harro Höfliger Verpackungsmaschinen GmbH, Allmersbach im Tal (DE)

( * ) Notice: Subject to any disclaimer, the term of this patent is extended or adjusted under 35 U.S.C. 154(b) by 297 days.

(21) Appl. No.: 16/537,924

(22) Filed: Aug. 12, 2019

(65) Prior Publication Data

US 2020/0047937 A1 Feb. 13, 2020

(30) Foreign Application Priority Data

Aug. 13, 2018 (EP) ..... 18188659

(51) Int. Cl.
*B65B 69/00* (2006.01)
*B65B 29/02* (2006.01)

(52) U.S. Cl.
CPC ..... *B65B 69/0033* (2013.01); *B65B 29/028* (2017.08)

(58) Field of Classification Search
CPC ..... B65B 69/0008; B65B 69/0033; B65B 69/0058; B65B 29/028; B65B 43/42; A61J 1/10; A61J 1/16
See application file for complete search history.

(56) References Cited

U.S. PATENT DOCUMENTS 4,523,679 A * 6/1985 Paikoff ..... A61L 2/04 206/363
5,551,215 A * 9/1996 McDonald ..... B65B 43/28 53/459
5,779,973 A * 7/1998 Edwards ..... A61L 2/20 422/28

(Continued)

FOREIGN PATENT DOCUMENTS

CN 201085783 7/2008
CN 202063314 U 12/2011

(Continued)

*Primary Examiner* — Andrew M Tecco
*Assistant Examiner* — Nicholas E Igbokwe
(74) *Attorney, Agent, or Firm* — Smartpat PLC

(57) ABSTRACT

The disclosure relates to a method for unpacking and separating infusion bags into singles for supplying the bags to a device for further processing. It includes the following steps: Opening an outer packaging, in which the infusion bags are present, by an opening device, wherein the infusion bags are fastened in groups to a holding device inside the outer packaging. Separating the group of infusion bags, which are fastened to the holding device, from the outer packaging by a separating device. Position the holding device with the infusion bags fastened thereon in a transport device by a positioning device. Processing the infusion bags by device for further processing.

10 Claims, 5 Drawing Sheets

(56) References Cited

U.S. PATENT DOCUMENTS

| | | | | |
|---|---|---|---|---|
| 5,810,706 | A * | 9/1998 | McDonald | B65B 43/123 383/35 |
| 9,511,945 | B2 * | 12/2016 | Greyshock | B65G 35/00 |
| 2005/0133674 | A1 * | 6/2005 | Sobue | A61J 1/16 248/95 |
| 2008/0051937 | A1 * | 2/2008 | Khan | B65B 3/30 700/240 |
| 2016/0059977 | A1 * | 3/2016 | Bikerman | B65B 51/04 53/384.1 |
| 2018/0064703 | A1 * | 3/2018 | Kumar | A61K 31/485 |

FOREIGN PATENT DOCUMENTS

| | | | |
|---|---|---|---|
| CN | 203793865 | U | 8/2014 |
| CN | 104386328 | A | 3/2015 |
| CN | 204280116 | U | 4/2015 |
| CN | 105173248 | A | 12/2015 |
| CN | 205396877 | U | 7/2016 |
| CN | 205441862 | U | 8/2016 |
| CN | 107140271 | A | 9/2017 |
| CN | 107161448 | A | 9/2017 |
| CN | 207089844 | U | 3/2018 |
| CN | 207482236 | U | 6/2018 |
| CN | 108284978 | A | 7/2018 |
| CN | 208877299 | U | 5/2019 |
| DE | 10211116 | | 5/2015 |
| DE | 202018002685 | U1 | 6/2018 |
| WO | 2017099195 | A1 | 6/2017 |

* cited by examiner

METHOD FOR UNPACKING AND SEPARATING INFUSION BAGS INTO SINGLES FOR SUPPLYING THE BAGS TO A DEVICE FOR FURTHER PROCESSING

TECHNICAL FIELD

The disclosure relates to a method where empty infusion bags, which, as a rule, are delivered sterilized, can be unpacked and separated into singles. The infusion bags can then be supplied to a device for further processing, for example to fill the infusion bags with a liquid. The infusion bags can be bags with just one chamber, but also multi-chamber bags. Multi-chamber bags can also include, for example, a powder and a liquid chamber.

BACKGROUND

The supplying and the unpacking of sterile infusion bags are usually realized by manual production steps. The sterile infusion bags are delivered in an outer packaging. The outer packaging with the infusion bags is disinfected and transferred into a first processing room, which is equipped with glove ports. In said first processing room, the outer packaging is opened manually by an operator and the individual infusion bags are removed from the outer packaging. Multiple infusion bags are placed in a transfer tray and disinfected once again before the transfer tray together with the infusion bags is transferred into a second processing room. The processing is also effected manually in said second processing room by an operator who has to operate by means of glove ports. The infusion bags are first of all separated into singles by the operator. As the infusion bags are frequently positioned inside the outer packaging by applying vacuum, said separating into singles can take up a certain amount of time as the infusion bags can stick to one another. The infusion bags separated into singles are transferred into a third processing room which is also equipped with glove ports. The individual infusion bags are arranged in a defined alignment by a further operator in said processing room and are transferred to the device for further processing. For example, the individual infusion bags can be placed into the transport compartments of a conveyor belt. As an alternative to this, the infusion bags can also be suspended on transport grippers.

Said stepwise unpacking by operators in glove ports is viewed increasingly with criticism. Working with glove ports is physically difficult for the operators so that signs of fatigue are obvious relatively quickly. Maintaining the sterility is also viewed increasingly with criticism as subsequent contamination of the open inside of the outer packaging or also of the infusion bags cannot be safely ruled out.

SUMMARY

The object underlying the invention is to provide an improved method for unpacking and separating infusion bags into singles which manages largely without operators in glove ports and avoids contact with the actual infusion bags as completely as possible.

The method according to the invention is provided by the features of the independent claim. Sensible further developments of the invention are the subject matter of the dependent claims.

In the case of the method for unpacking and separating infusion bags into singles, first of all an outer packaging is opened mechanically by means of an opening device. The infusion bags are fastened in groups to a holding device in said outer packaging. Once the outer packaging has been opened, the infusion bags are separated from the outer packaging by means of a separating device. The individual infusion bags remain fastened to the holding device during said step. By means of a positioning device, each holding device with the infusion bags fastened thereto is then positioned in a transport device so that the infusion bags can be supplied to a device for further processing.

In a first embodiment, just one group of infusion bags can be present in the outer packaging. This can be the case, in particular, with outer packagings in the form of bags, for example in the form of tubular bags or sealed bags. As an alternative to this, in a second embodiment multiple groups of infusion bags can be present in one outer packaging, each group being fastened to its own holding device. This can be the case, in particular, with such outer packagings which have a trough-like receptacle for the infusion bags. In dependence on the depth of the trough-like receptacle, the individual holding devices with the infusion bags can lie in a fan-like manner in the trough-like receptacle or can be present suspended side by side in the trough-like receptacle.

When using a trough-like receptacle as outer packaging, said trough-like receptacle can preferably be closed with a sealed lidding film. The lidding film can be removed, in this case, by the opening device. This can be effected preferably by pulling off the lidding film. In principle, it would also be possible to cut an opening in the lidding film in order to open the outer packaging.

When using an outer packaging in the form of a bag, the opening of the bag can be effected in a particularly simple manner by cutting the bag open. The bag can simply be provided with a slit for this purpose. It would also be possible to sever part of the bag by a cut in order to open the outer packaging.

The opened outer packaging can then be tipped up by the separating device. As a result, the infusion bags with the holding device can slip out of the opened outer packaging. The infusion bags slipping out in this manner is possible both with a bag as outer packaging and with a flat trough-like receptacle as outer packaging.

Insofar as the holding devices are present, in contrast, suspended in the trough-like receptacle, they can be gripped and removed by the separating device together with the infusion bags.

In principle, it is possible to supply the infusion bags in groups to a device for further processing. In this case, the holding device would simply have to be aligned and transferred to a transport device in a defined position. Said method step can be taken over by the positioning device. The infusion bags can then be filled in groups, for example, with the desired liquid.

In a preferred embodiment, the infusion bags can be separated from the holding device prior to the transfer to the device for further processing. The infusion bags can consequently be processed individually. The advantage of this is that, as a rule, the design of the device for further processing can remain unchanged as, hitherto, the device for further processing also received the infusion bags already separated into singles and aligned. The separation of the infusion bags from the holding device can be carried out, in this case, in particular, by the positioning device or by the transport device. The infusion bags can preferably be separated into singles directly during the separation from the holding device so that no other separate separating-into-singles operation is necessary. The infusion bags can be aligned directly after the separation or also indirectly during the separating operation from the holding device so that a defined transfer to a device for further processing is possible. As a result, a separate method step for the alignment of the infusion bags can be saved.

Further advantages and features can be found in the features additionally specified in the claims and in the exemplary embodiments below.

DETAILED DESCRIPTION

A first variant of the method is shown in steps in FIGS. 1 to 6. Multiple infusion bags 10 are fastened to a holding device 12. In the present case, the holding device 12 is packed with the sterilized infusion bags 10 in a tubular bag 20 as outer packaging. Instead of the tubular bag 20, a sealed bag or another bag could also be used, for example, as outer packaging. The outer packaging 20 is first of all disinfected on the outside and then moved into a clean room in which the further method steps are carried out by means of corresponding devices.

Figure 1:
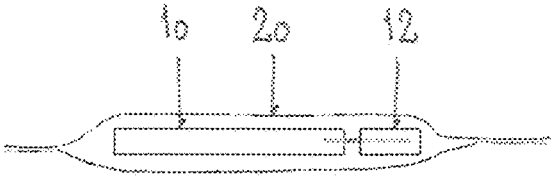
FIG. 1 shows a schematic cross section through a holding device with infusion bags, which holding device is present in a tubular bag as outer packaging.
Figure 2:
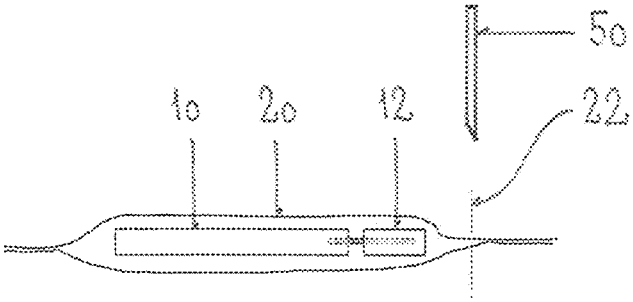
FIG. 2 shows a cross section corresponding to FIG. 1 with a cut through the outer packaging.
Figure 3:
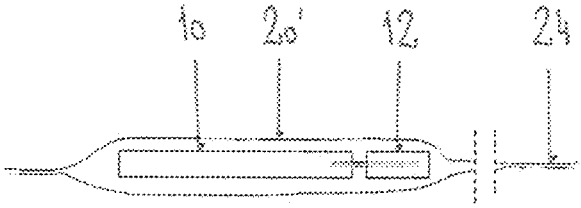
FIG. 3 shows a cross section corresponding to FIG. 2 with a flap of the outer packaging separated off.
Figure 4:
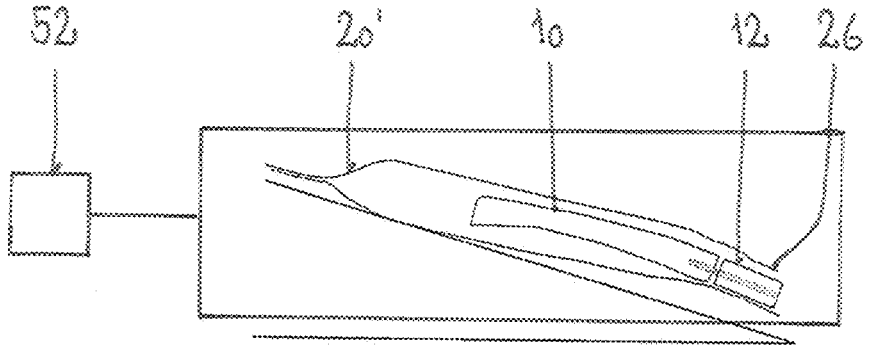
FIG. 4 shows a cross section corresponding to FIG. 3 with the outer packaging tipped up.
Figure 5:
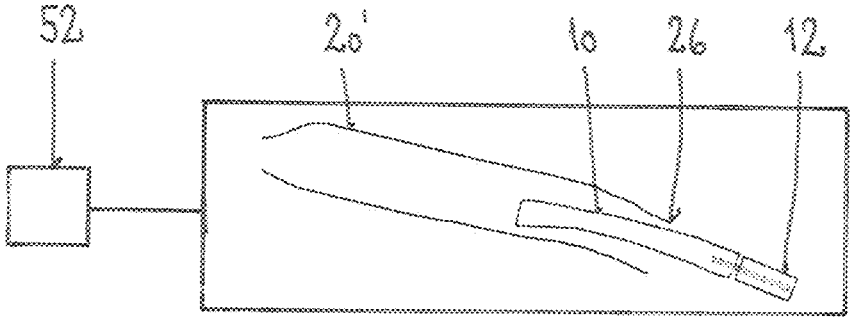
FIG. 5 shows a cross section corresponding to FIG. 4 where the holding device with the infusion bags slips out of the outer packaging.
Figure 6:
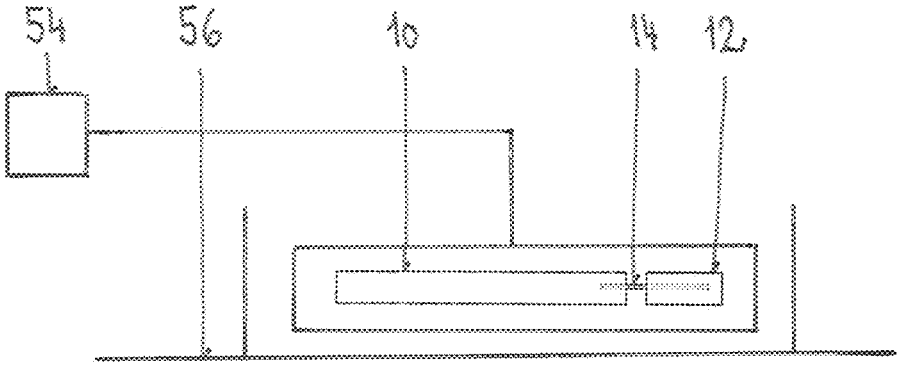
FIG. 6 shows a cross section through the holding device with infusion bags which has been separated from the outer packaging.

According to FIG. 2, the tubular bag 20 is first of all cut open by an opening device 50 which is only shown schematically here. The cut 22 is effected, in this case, in the vicinity of the holding device 12 in order not to damage the infusion bags 10 inadvertently during the cutting operation. The severed part 24 of the outer packaging 20' is then removed (FIG. 3).

The opened outer packaging 20' is then tipped up by a separating device 52, which is also only shown schematically, so that the open side 26 of the outer packaging 20' points downward. As a result, the infusion bags 10 with the holding device 12 slip out of the opened outer packaging 20'(see FIG. 5). The empty outer packaging 20' can then be disposed of whilst the holding device 12 with the infusion bags 10 can be processed further. As a rule, the holding device 12 with the infusion bags 10 fastened thereto is transferred from a positioning device 54 to a transport device 56.

Figure 7:
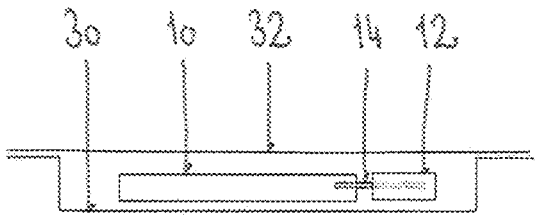
FIG. 7 shows a schematic cross section through a holding device with infusion bags, which holding device is present as outer packaging in a flat trough-like receptacle.
Figure 8:
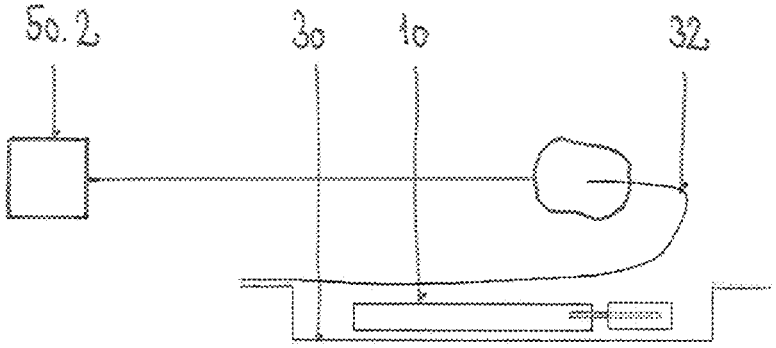
FIG. 8 shows a cross section corresponding to FIG. 7 with the lidding film of the outer packaging partially removed.
Figure 9:
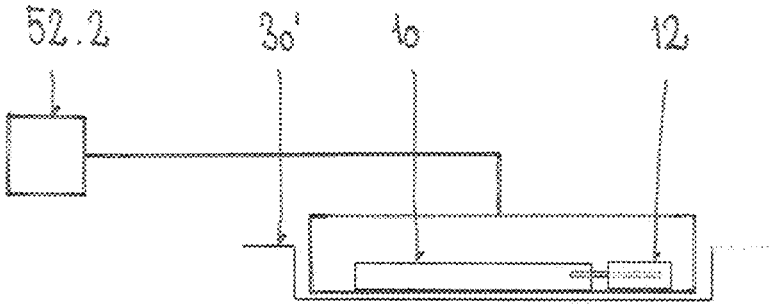
FIG. 9 shows a cross section corresponding to FIG. 8 with the outer packaging opened.

Instead of the tubular bag 20, a flat trough-like receptacle 30 can also be used for storing the infusion bags 10 which are fastened to the holding device 12 (see FIGS. 7 to 9). The trough-like receptacle 30 is closed by way of a sealed lidding film 32. After the decontamination of the outsides of the closed trough-like receptacle 30, the lidding film 32 can be removed in a clean room by an opening device 50.2, which is only shown schematically here (see FIGS. 8 and 9). In the present example case, the lidding film 32 is pulled completely off the trough-like receptacle 30. As an alternative to this, a flat opening could also be cut into the lidding film 32, through which the individual holding devices 12 with infusion bags 10 could be removed.

Figure 10:
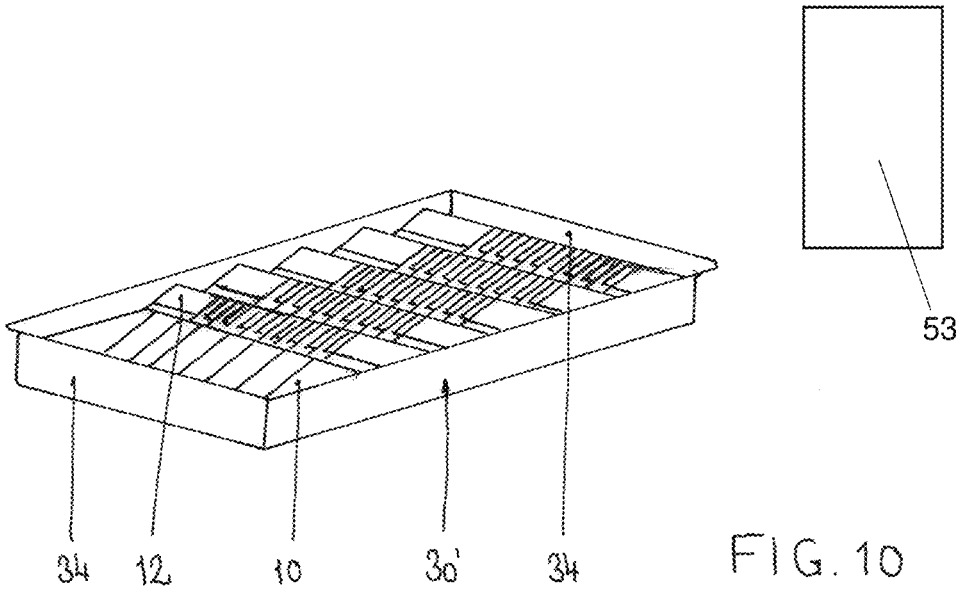
FIG. 10 shows a perspective view of holding devices which are arranged in a flat trough-like receptacle and are provided in each case with multiple infusion bags.
Figure 11:
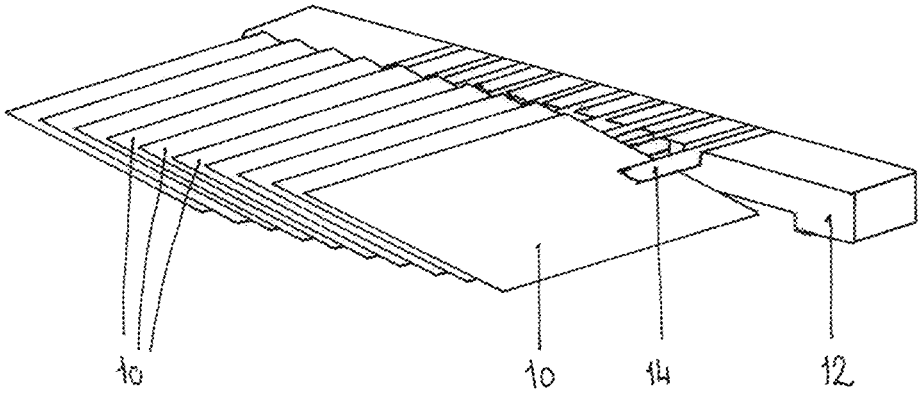
FIG. 11 shows a perspective view of a holding device with infusion bags according to FIG. 10.

As can be seen in FIG. 10, multiple holding devices 12 with infusion bags 10 fastened thereto can be stored and transported in a trough-like receptacle 30. The individual holding devices 12 (see also FIG. 11) are each provided, in this case, with multiple infusion bags 10, the infusion bags 10 being arranged overlapping one another in a fan-like manner. The infusion bags 10 are fastened to the holding device 12 via a hose attachment 14 in the present example case. The hose attachment 14 of each infusion bag 10 is clamped, in this case, in the holding device 12. In this case, the distances between two adjacent hose attachments 14 are identical in each case so that an exact alignment of the infusion bags 10 on the holding device 12 is provided. Said exact alignment of the infusion bags 10 enables the defined processing and transfer of the infusion bags 10, which have been separated into singles, to an arbitrary device for further processing 53 without manual alignment by operators being necessary.

Multiple holding devices 12 lie slightly offset one above another inside the trough-like receptacle 30. Insofar as the side walls 34 of the trough-like receptacle 30 extend in a sufficiently flat manner, the removal of the individual holding devices 12 could be effected as a result of tipping up the opened trough-like receptacle 30'. As an alternative to this, the individual holding devices 12 could also be removed from the opened trough-like receptacle 30 by means of a gripping device as separating device 52.2. The individual holding devices 12 with the infusion bags 10 can then be processed further.

Figure 12:
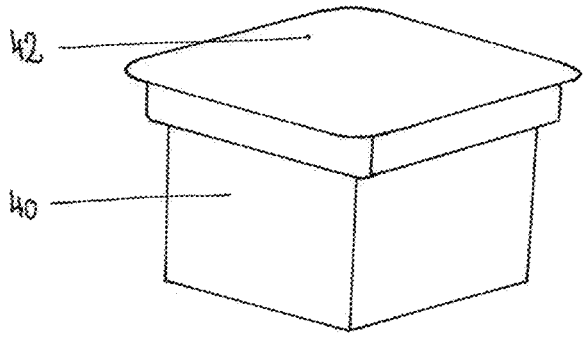
FIG. 12 shows a perspective view of a closed deep trough-like receptacle as outer packaging.
Figure 13:
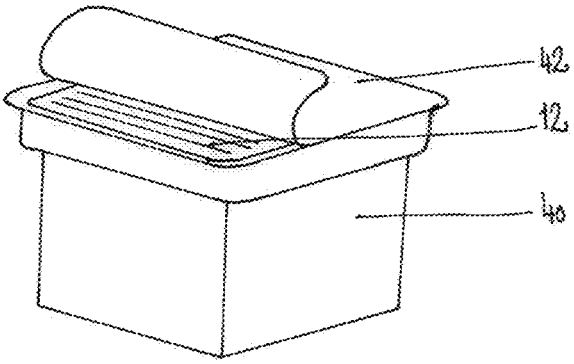
FIG. 13 shows a perspective view corresponding to FIG. 12 with the lidding film of the outer packaging partially removed.
Figure 14:
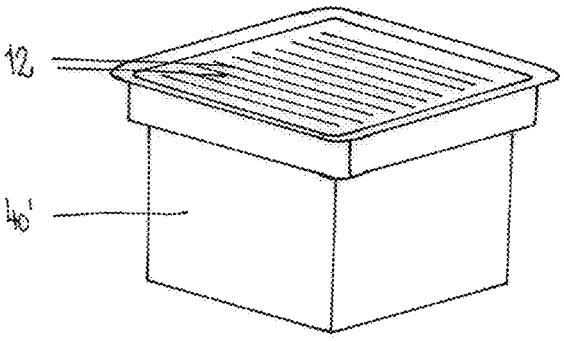
FIG. 14 shows a perspective view corresponding to FIG. 13 with the outer packaging opened.

Instead of the flat trough-like receptacle 30, a comparatively deep trough-like receptacle 40 could also be used for storing the holding device 12 with infusion bags 10 (see FIGS. 12 to 14). The individual holding devices 12 could be present in said trough-like receptacle 40 suspended in such a manner that the infusion bags 10 each hang downward (see FIG. 14). The trough-like receptacle 40 is closed with a sealed lidding film 42. After the decontamination of the outsides of the closed trough-like receptacle 40, the lidding film 42 can be removed in a clean room by an opening device which is not shown here (see FIGS. 13 and 14). In the present example case, the lidding film 42 is pulled completely off the trough-like receptacle 40. As an alternative to this, a flat opening could also be cut into the lidding film 42, through which the individual holding devices 12 with infusion bags 10 could be removed. Once the lidding film 42 has been removed, the individual holding devices 12 with the infusion bags 10 can be removed out of the opened trough-like receptacle 40' by means of a gripping device which is not shown here. The individual holding devices 12 with the infusion bags 10 can then be processed further.

What is claimed is:

1. A method for unpacking and separating infusion bags into singles for supplying the infusion bags to a device for further processing, said method having the following method steps:

opening an outer packaging, in which the infusion bags are present, by an opening device, while the infusion bags are fastened in groups to a holding device inside the outer packaging;

separating the group of infusion bags, which are fastened to the holding device, from the outer packaging by a separating device;

positioning the holding device with the infusion bags fastened thereon in a transport device by a positioning device; and processing the infusion bags by a device for further processing, wherein opening the outer packaging includes removing a lidding film from a trough-like receptacle.

2. The method according to claim 1, further comprising tipping up the opened outer packaging by the separating device so that the infusion bags slip out of the outer packaging.

3. The method according to claim 1, wherein the infusion bags, which are fastened to the holding device, are removed in groups from the opened outer packaging by the separating device.

4. A method for unpacking and separating infusion bags into singles for supplying the infusion bags to a device for further processing, said method having the following method steps:

opening an outer packaging, in which the infusion bags are present, by an opening device, while the infusion bags are fastened in groups to a holding device inside the outer packaging;

separating the group of infusion bags, which are fastened to the holding device, from the outer packaging by a separating device;

positioning the holding device with the infusion bags fastened thereon in a transport device by a positioning device; and processing the infusion bags by a device for further processing, wherein opening the outer packaging includes cutting open a bag.

5. The method according to claim 4, wherein the bag is a tubular bag or a sealed bag.

6. The method according to claim 4, further comprising tipping up the opened outer packaging by the separating device so that the infusion bags slip out of the outer packaging.

7. The method according to claim 4, wherein the infusion bags, which are fastened to the holding device, are removed in groups from the opened outer packaging by the separating device.

8. A method for unpacking and separating infusion bags into singles for supplying the infusion bags to a device for further processing, said method having the following method steps:

opening an outer packaging, in which the infusion bags are present, by an opening device, while the infusion bags are fastened in groups to a holding device inside the outer packaging;

separating the group of infusion bags, which are fastened to the holding device, from the outer packaging by a separating device;

positioning the holding device with the infusion bags fastened thereon in a transport device by a positioning device; and processing the infusion bags by a device for further processing, wherein the infusion bags are separated from the holding device by the positioning device or by the transport device.

9. The method according to claim 8, wherein the infusion bags are separated into singles during the separation from the holding device.

10. The method according to claim 8, wherein after the separation from the holding device, the infusion bags are aligned such that a defined transfer to a device for further processing is possible.

* * * * *